United States Patent [19]

Clark et al.

[11] Patent Number: 4,886,579

[45] Date of Patent: Dec. 12, 1989

[54] ADHESIVE MATERIAL FOR CREPING OF FIBROUS WEBS

[75] Inventors: James W. Clark, Wallingford; Chauncey C. De Pugh, Media, both of Pa.

[73] Assignee: Scott Paper Company, Philadelphia, Pa.

[21] Appl. No.: 187,752

[22] Filed: Apr. 29, 1988

[51] Int. Cl.[4] ..... D21H 5/24

[52] U.S. Cl. ..... 162/111; 162/112; 264/283

[58] Field of Search ..... 162/111, 112, 113, 168.1, 162/169; 156/183; 264/283

[56] References Cited

U.S. PATENT DOCUMENTS 4,063,995 12/1977 Grossman ..... 162/112

*Primary Examiner*—Peter Chin

*Attorney, Agent, or Firm*—John A. Weygandt; John W. Kane, Jr.

[57] ABSTRACT

A creping adhesive formulation comprising 10–100% by weight of a polymer or copolymer having a Tg greater than 50° C.

8 Claims, No Drawings

ADHESIVE MATERIAL FOR CREPING OF FIBROUS WEBS

BACKGROUND OF THE INVENTION

1. Field of the Invention

The present invention relates generally to materials for use in the manufacture of creped fibrous webs. More particularly, it relates to a formulation which reduces or eliminates blocking.

2. Description of the Related Art

Inventors in the prior art have developed methods for providing strength and abrasion resistance to the surface of a fibrous web while at the same time increasing the softness, absorbency and bulk of the web. U.S. Pat. No. 3,879,257, granted Apr. 22, 1975 to Gentile et al, discloses a unitary or single-ply fibrous web having a laminate-like structure which consists of a soft, absorbent central core region of relatively low fiber concentration sandwiched between two strong, abrasion resistant surface regions. According to Gentile et al, the surface regions are formed by application of a bonding material, preferably elastomeric. The bonding material in at least one surface region is disposed in a fine, space-apart pattern, and the bonded portions in that surface region are finely creped to soften them. According to Gentile et al, the bonding material adheres the web in a pattern to a creping surface from which it is removed by a doctor blade to greatly disrupt the fibers within the web where bonding material is not disposed. This "bonding material", which adheres the web to the creping surface in a controlled manner, is variously referred to in the art as "binder", "adhesive" or more particularly "creping adhesive".

Where the present invention has its greatest utility in processes derived from the teachings of Gentile et al, the term "creping adhesive" will be employed herein to describe a bonding material which performs the functions of adhering a fibrous web to a creping surface and imparting strength to the creped sheet by bonding the fibers together. As thus broadly defined it encompasses materials applied to the surface of the web or to the creping surface.

The concepts of Gentile et al were extended to the formation of laminates of two or more dry webs in Salmeen et al, U.S. Pat. No. 4,610,743, granted Sept. 9, 1986. According to Salmeen et al, as in Gentile et al, both surface regions of the resulting product have creping adhesive disposed therein. Another variation on patterned creping of fibrous webs is disclosed by Klowak et al, U.S. Pat. No. 4,125,659 granted Nov. 14, 1978. According to Klowak et al, a creping adhesive is uniformly applied to just one side of the web and after the web has been adhered to the creping cylinder, a raised pattern is pressed into the web toward the creping cylinder. While all of these patented processes offer substantial improvements in strength and absorbency, the products can suffer from a serious disadvantage, not mentioned in any of the patents, which is "blocking".

The term "blocking" refers to the tendency of adhesively bonded webs or sheets to adhere to one another when in contact under pressure such as when wound up on a reel or when packaged in rolls or stacks. This negative characteristic interferes with the conversion of parent rolls and the dispensing and unfolding of the finished product. The tendency of creped web to "block" is proportional to the amount of creping adhesive on the surface of the web and thus is more severe in the case of pattern-creped, adhesively bonded materials such as described by Gentile et al and others mentioned above.

The phenomenon of blocking of creped fibrous sheets is specifically addressed by Grossman in U.S. Pat. No. 4,063,995, granted Dec. 20, 1977. The term is defined therein at Col. 1, lines 58–66. Grossman teaches the use of a four component binder and creping adhesive composition comprising, inter alia, a blocking suppressant. Grossman describes a variety of materials as being suitable blocking suppressants among them being any of the known polymers suitable for use as a binder for fibers "provided it has a glass transition temperature of from about +30° C. to about +50° C. so that it will function as a blocking suppressant." Col. 6, lines 17–22.

SUMMARY OF THE INVENTION

The present invention provides a new, improved creping adhesive comprising a polymer or copolymer having a Tg of more than 50° C. Preferably, the creping adhesive further comprises a second component which is a soft polymer emulsion having a Tg below 10° C. and which cross-links upon drying and heating. The hard polymer component makes up from 10% to 100% and preferably 25% to 40% of the formulation by weight of the total solids content of the formulation. A further characteristic of the hard polymer component is that it does not form a film at ambient (room) temperature. Specifically preferred as the hard polymer is poly(-methyl methacrylate). The combination is non-blocking when used as a creping bonding material. The term "non-blocking" as used herein indicates that the webs separate readily, as will be described in greater detail hereinafter. By following the teachings of the present invention, it is actually possible to attain "zero" blocking wherein the sheets separate under the force of the weight of one web. Other things being equal, blocking tends to be proportional to the concentration of creping adhesive at the surface of the web. Accordingly, the problem the present invention seeks to solve, namely blocking, is primarily associated with creped webs which have relatively high concentrations of creping adhesive at the surface, such as webs made in accordance with the teachings of Gentile et al and others mentioned above, that is to say patterned creping. However, the invention has applicability to any type of conventional creping process wherein the web is adhered to a creping surface (a heated rotating drum) and removed with a doctor blade (creping blade). The creping adhesive, which also adheres the web to the creping surface, can be applied to the creping surface itself or to the fibrous sheet by any suitable means. It can be sprayed onto the fibrous sheet or onto the creping surface. It can be transferred uniformly over all or printed in a pattern. The pattern may be a continuous one or consist of spaced apart dots or discontinuous lines. Discontinuous patterns result in more pleasing tactile properties, i.e., better "handfeel". Long fibers (longer than wood pulp fibers) may be incorporated in the web to compensate for the lesser strength of a discontinuous pattern.

In carrying out the present invention, a fibrous base web is produced as a continuous web from substantially all wood pulp fibers or in combination with long fiber elements. To provide soft, non-blocking fibrous webs, it is preferred to blend a self-cross-linkable soft binder having a Tg of less than 10 degrees Celsius with a non-film forming hard polymer emulsion having a Tg greater than 50 degrees Celsius. The optimum solids blend may be formulated by selecting the ratio of soft polymer to the hard polymer which provides the non-blocking feature while providing adequate adhesion to the creeping surface and the least compromise to tensile strength and handfeel. To applicant's knowledge, the use of a hard polymer or copolymer having a Tg greater than 50 degrees Celsius either exclusively or at a level greater than 10% with a soft polymer having a Tg of 10 degrees Celsius or less in an aqueous dispersion to provide a non-blocking creping adhesive has not heretofore been employed because the hard polymer components as such are viewed as being non-film-forming at room temperature. It is unobvious to use these hard polymers in a high concentration suggested by this invention of 10% or more, as one of ordinary skill in the art would expect to achieve a harsh surface which is board-like or disintegrates into powder when touched.

In the preferred mode of carrying out the present invention for making heavyweight tissue to be converted into, for example towels or wipers, the creping adhesive comprises cross-linking polymers and is applied to the sheet material at one or more print stations typical in a patterned creping process to provide a fibrous web which remains soft to the hand but does not block. As will be understood by one of ordinary skill in the art to which the present invention pertains, if a lighter weight, flushable sheet is desired, for example for conversion into bathroom tissue or facial tissue, then the creping adhesive consists of non-cross-linking polymers and is applied to the web in a lesser quantity preferably by application to the creping surface.

DETAILED DESCRIPTION

The following examples taken from actual operating data will serve to more fully illustrate our invention. In the examples which follow, the bonding material was applied to both sides of a previous formed and dried paper web having a basis weight of 76 grams per square meter and creped by printing creping adhesive on the first side with a diamond pattern, pressing and adhering the first side to a hot creping cylinder, then removing the web with a doctor blade and pull rolls rotating at the same speed as the creping cylinder. Immediately thereafter, the second side is printed with creping adhesive and adhered to a second hot creping cylinder, then removed with a doctor blade and pull rolls, rotating slower than the creping cylinder. After creping, the web is passed through a hot thru-air curing oven to raise the temperature of the web to 150° C., followed by winding on the reel, where the percentage crepe from the second pull rolls to the reel is 12%.

The adhesive components in these examples are aqueous emulsions of polymers or copolymers as identified below. Each is cross-linkable, except where noted to the contrary. Because the examples were selected to be illustrative, polymer identification numbers are not inclusive.

| Polymer/Copolymer | Tg, °C. |
|---|---|
| 1. acrylic copolymer | −33 |
| 3. ethylene/vinylacetate copolymer | 0 |
| 4. poly(methyl methacrylate) | +100 |
| 5. styrene/butadiene | 0 |
| 6. ethylene/vinylacetate | 0 |
| 7. vinylacetate/acrylate | 0 |
| 8. styrene/acrylic | 56 |

-continued

| Polymer/Copolymer | Tg, °C. |
|---|---|
| 9. acrylic | −33 |
| 10. styrene/non-crosslinking | +100 |
| 11. styrene/butadiene | −3 |
| 13. styrene, non-crosslinking | 100 |
| 14. vinylacetate/ethylene | −2 |
| 15. acrylic terpolymer | −30 |

| Component Nos. | % Soft Comp | % Hard Comp | Basis Weight g/m² | Bulk mm | Bulk to Basis Weight | Geometric Mean Dry Tensile Kg/cm | Blocking* (grams) |
|---|---|---|---|---|---|---|---|
| 1 | 100 | 0 | 103.0 | 14.3 | 0.139 | 9.55 | 12 |
| ¼ | 75 | 25 | 108.1 | 14.6 | 0.135 | 8.88 | 3 |
| ¼ | 50 | 50 | 107.5 | 16.5 | 0.153 | 8.26 | 0 |
| ¼ | 25 | 75 | 103.6 | 16.6 | 0.160 | 4.73 | 0 |
| 3 | 100 | 0 | 97.0 | 15.9 | 0.164 | 11.33 | 14 |
| ⅜ | 40 | 60 | 91.4 | 14.5 | 0.159 | 13.51 | 0 |
| ⅜ | 35 | 65 | 95.1 | 18.5 | 0.195 | 9.70 | 0 |
| ⅜ | 25 | 75 | 94.0 | 18.1 | 0.193 | 9.09 | 0 |
| ⅜ | 10 | 90 | 94.3 | 17.7 | 0.188 | 9.01 | 0 |
| 8 | 0 | 100 | 94.5 | 17.9 | 0.189 | 10.22 | 0 |
| 9 | 100 | 0 | 102.9 | 14.3 | 0.139 | 9.55 | 12 |
| 9/4 | 75 | 25 | 108.1 | 14.6 | 0.135 | 8.88 | 3 |
| 9/4 | 70 | 30 | 96.5 | 16.1 | 0.167 | 8.38 | 2 |
| 9/4 | 60 | 40 | 96.5 | 16.1 | 0.167 | 8.28 | 0 |
| 9/4 | 50 | 50 | 103.2 | 16.3 | 0.158 | 8.56 | 0 |
| 9/4 | 25 | 75 | 103.6 | 16.6 | 0.160 | 4.73 | 0 |
| 9/8 | 60 | 40 | 93.4 | 14.3 | 0.153 | 7.69 | 0 |
| 9/8 | 55 | 45 | 94.9 | 14.5 | 0.153 | 8.75 | 0 |
| 9/8 | 40 | 60 | 94.1 | 14.3 | 0.152 | 11.00 | 0 |
| 9/10 | 60 | 40 | 95.5 | 16.9 | 0.177 | 7.76 | 0 |
| 11 | 100 | 0 | 92.3 | 15.4 | 0.167 | 11.13 | 23 |
| 11/13 | 75 | 25 | 89.7 | 14.9 | 0.166 | 11.62 | 2 |
| 11/13 | 50 | 50 | 91.3 | 15.4 | 0.169 | 11.24 | 0 |
| 14 | 100 | 0 | 94.0 | 14.9 | 0.159 | 10.89 | 23 |
| 14/10 | 60 | 40 | 94.9 | 17.0 | 0.179 | 10.62 | 1 |
| 14/10 | 50 | 50 | 93.8 | 13.7 | 0.146 | 12.88 | 0 |
| 15/4 | 60 | 40 | 96.2 | 14.3 | 0.149 | 9.95 | 0 |

The blocking values are obtained by placing together a strip 10.2 cm wide×15.2 cm, long smooth side to smooth side, the smooth side being defined as the less undulated of the two surfaces, (cf. Gentile et al, column 16, lines 27–41), the strips are maintained under a pressure of 18 grams per square centimeter and a temperature of 60 degrees C. for 12 hours followed by cooling to room temperature for 12 hours. This cycle of heating and cooling was repeated up to 4 times, the number of iterations being held constant for any series of creping adhesive compositions. After the final cooling period to room temperature, the blocking level is measured as the number of grams in excess of the weight of the two strips, pulling on the top sheet lying in a horizontal plane with a hand held scale. Zero blocking is the condition where the weight of the bottom sheet is great enough to separate the two sheets. When the blocking is great enough to lift the top sheet, the scale is used, hooked to the top sheet while the adjacent edge of the bottom sheet is clamped to the supporting surface during pulling with the scale to obtain the reading in grams.

In the following examples, the creping adhesive was applied to a single side of the web; and the creping step was performed as above described but on one side only.

The adhesive components in these examples are aqueous emulsions of polymers or copolymers as identified below. Each is cross-linkable, except where noted to the contrary. Because the examples were selected to be illustrative, polymer identification numbers are not inclusive.

| Polymer/Copolymer | Tg, °C. |
|---|---|
| 1. carboxylated styrene/butadiene | −33 |
| 2. poly(methyl methacrylate) non-cross-linking | +100 |
| 3. ethylene/vinyl acetate | 0 |
| 4. poly(methyl methacrylate) | +100 |
| 6. ethylene/vinyl acetate | 0 |
| 7. vinyl acetate/acrylate | 0 |

| Component Nos. | % Soft Comp | % Hard Comp | Basis Weight g/m$^2$ | Bulk mm | Bulk to Basis Weight | Geometric Mean Dry Tensile Kg/cm | Blocking* (grams) |
|---|---|---|---|---|---|---|---|
| 1 | 100 | 0 | 77.83 | 11.0 | .141 | 4.89 | 18 |
| ½ | 50 | 50 | 83.19 | 11.7 | .141 | 5.60 | 1 |
| 2 | 0 | 100 | 79.68 | 9.7 | .122 | 6.91 | 0 |
| 3 | 100 | 0 | 80.56 | 15.8 | .196 | 2.15 | 20 |
| 4 | 0 | 100 | 79.00 | 9.5 | .120 | 6.36 | 0 |
| 6/2 | 50 | 50 | 82.27 | 16.5 | .201 | 2.69 | 2 |
| 6 | 100 | 0 | 80.93 | 17.1 | .211 | 1.55 | 14 |
| 7 | 100 | 0 | 82.27 | 16.7 | .203 | 4.44 | 8 |
| 7/2 | 50 | 50 | 83.14 | 14.0 | .168 | 4.25 | 1 |

*NOTE:
The blocking values were obtained as described above with respect to sheets creped on both sides except that the sheets were placed together printed side to printed side, i.e., the sides to which the adhesive had been applied were adjacent and touching.

The hand feel, i.e., the tactile perception of the surface, of the sheet obtained using the creping adhesive of the present invention is typical of the hand feel of conventional products made by the patterned creping process.

Although the invention has been described with reference to preferred creping methods, other methods and uses for the disclosed creping adhesive may be devised without departing from the spirit and scope of the invention as defined by the appended claims.

What is claimed is:

1. In a method of creping a fibrous web wherein the creping adhesive is applied to the fibrous web before it contacts the creping surface, the improvement consisting of applying a creping adhesive which comprises at least 10% by weight of the total solids content of said formulation of a polymer or copolymer having a Tg greater than 50° C.

2. The method in accordance with claim 1 wherein the creping adhesive further comprises a polymer or copolymer having a Tg below 10° C.

3. The method in accordance with claim 1 wherein the polymer is poly(methyl methacrylate).

4. The method in accordance with claim 2 wherein said polymer or copolymer having a Tg below 10° C. is cross-linking.

5. In a method of creping a fibrous web, wherein the creping adhesive is applied to the creping surface, the improvement consisting of applying a creping adhesive which comprises at least 10% by weight of the total solids content of said formulation of a polymer or copolymer having a Tg greater than 50° C.

6. The method in accordance with claim 5 wherein the polymer is poly(methyl methacrylate).

7. The method in accordance with claim 5 wherein the adhesive further comprises a polymer or copolymer having a Tg below 10° C.

8. The method in accordance with claim 7 wherein said polymers and copolymers are non-crosslinking.

* * * * *